United States Patent [19]

Kordt et al.

[11] 4,270,835

[45] Jun. 2, 1981

[54] RAIL-MOUNTED ELECTRICAL TERMINALS

[75] Inventors: Hans-Herbert Kordt, Osterode; Paul P. Stenz, Detmold, both of Fed. Rep. of Germany

[73] Assignee: C. A. Weidmuller KG, Detmold, Fed. Rep. of Germany

[21] Appl. No.: 60,700

[22] Filed: Jul. 25, 1979

[30] Foreign Application Priority Data

Jul. 29, 1978 [DE] Fed. Rep. of Germany ... 7822789[U]
Oct. 19, 1978 [DE] Fed. Rep. of Germany ..... 2845532

[51] Int. Cl.[3] ..... H01R 4/66; H01R 9/22
[52] U.S. Cl. ..... 339/198 GA; 339/272 R
[58] Field of Search ..... 339/198 M, 263 L, 272 R, 339/14 L

[56] References Cited

U.S. PATENT DOCUMENTS 4,018,502 4/1977 Glarsel ..... 339/198 GA

FOREIGN PATENT DOCUMENTS 1590344 7/1973 Fed. Rep. of Germany ... 339/198 GA
2352432 4/1975 Fed. Rep. of Germany ..... 339/272 R
2619506 11/1977 Fed. Rep. of Germany ... 339/198 GA
1387554 3/1975 United Kingdom ..... 339/198 N

*Primary Examiner*—Eugene F. Desmond
*Attorney, Agent, or Firm*—Pollock, Vande Sande & Priddy

[57] ABSTRACT

A clip-on electrical terminal block has an earth terminal which grips one flange of a channel-section support rail with outwardly turned flanges. To prevent the earth terminal from drifting in the case of a flange of tapered cross section, a clamping member of the flange not only engages the underside of the flange but also has an inner arm which engages the internal surface of the channel-section rail. A single clamping screw clamps together the earth conductor, the clamping member of the terminal, and the flange of the support rail, by means of a lower arm of the clamping member. To facilitate access to the clamping screw in the case of a terminal block with stacked terminals, the region of the terminal block housing containing the earth terminal may be laterally offset.

8 Claims, 3 Drawing Figures

RAIL-MOUNTED ELECTRICAL TERMINALS

Figure 1:
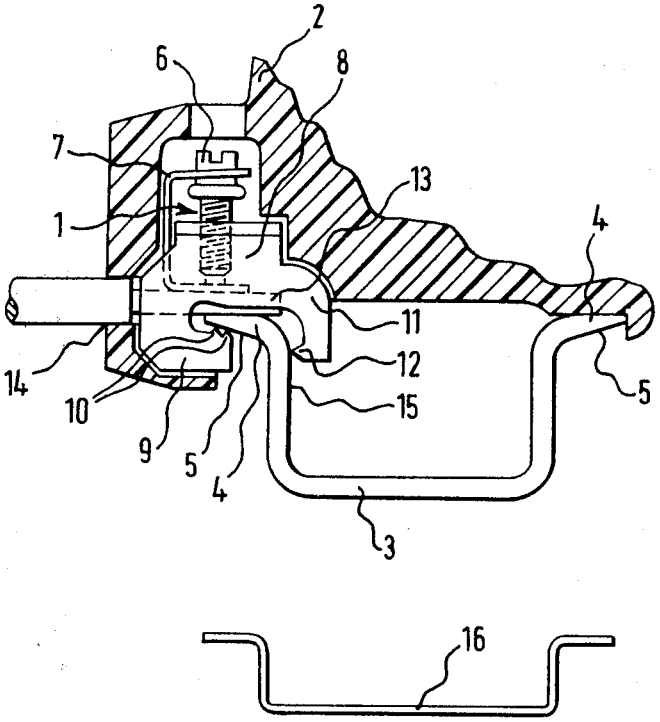

This invention relates to rail-mounted electrical terminal blocks, in particular of the well-known kind adapted to be mounted on a support rail of channel section with outwardly directed flanges.

Official standards for such rails, for example German Industrial Standard DIN 46277 and 50022, determine the shape and dimensions of the support rail. Two kinds of rail are permitted, each having an overall width of 35 mm. One rail is of relatively thin metal with a channel depth of 7.5 mm and a flange width of 5 mm. The other standard rail is of thicker metal with a channel depth of 15 mm and a flange width of 7.8 mm. In the latter case each flange is of tapered cross-section; this leads to difficulties when a terminal is to be secured by clamping on to such a tapered flange, because the taper of the flange prevents reliable clamping.

This problem arises in particular in the case of a terminal block incorporating an earth terminal which makes contact with the support rail and is clamped to one flange of the support rail by a clamping screw. Usually, the earth terminal has a portion which fits under the flange of the support rail and the clamping screw exerts pressure against the upper surface of the flange. In consequence of the tapered cross section of the flange, the clamping pressure tends to cause the earth terminal to drift towards the edge of the flange being clamped. This can cause severe stress in the insulating housing of the terminal block, which engages the other flange of the support rail and is therefore subjected to tension as a result of the drift. In extreme cases the terminal block can be pulled off the support rail, or the insulating housing can be broken. Conversely, if, when the terminal block is initially fixed on the rail, any play exists between the insulating housing and the other flange, subsequent drift of the earth terminal on its flange can reduce the clamping pressure and lead to unsatisfactory earthing.

An object of the present invention is to provide a rail-mounted terminal block incorporating an earth terminal which will not drift when mounted on a support rail of channel section with outwardly directed flanges of tapered cross section.

According to the present invention, there is provided an electrical terminal block for mounting on a support rail of channel section with outwardly directed flanges, which terminal comprises an insulating housing provided with means for gripping one said flange, and electrical terminals in the housing including an earth terminal provided with a first member arranged to engage under the other said flange of a support rail with a second member arranged to engage an internal side surface of the channel-section support rail adjacent to said other flange, and with a clamping screw arranged to clamp the said other flange against the said first member and to clamp an earth conductor in the earth terminal.

Also according to the invention, there is provided a rail-mountable terminal block comprising an insulating housing adapted to rest on one flange of a channel-section support rail with outwardly directed flanges, and and earth conductor terminal which grips under the other flange of the support rail by means of a clamping arm of an earth conductor-receiving clamping member of the terminal, characterized in that the clamping member further comprises an abutment arm arranged to grip behind the flange region of the support rail, and a common clamping screw is provided for clamping the conductor in the earth terminal and the latter to the rail.

In a terminal block embodying the invention, drift relative to the support rail is limited by the engagement of the earth terminal with the interior of the channel, and consequently the insulating housing is not subjected to stress. A small amount of drift will take place as the earth terminal is clamped, but this is desirable because it enables the earth terminal to break through the corrosion-protection layer commonly provided on metal support rails to prevent rusting, and therefore improves the electrical connection between the earth terminal and the support rail. Preferably, the earth terminal has at least one sharp tooth for engaging the support rail, which further improves the electrical connection.

Figure 2:
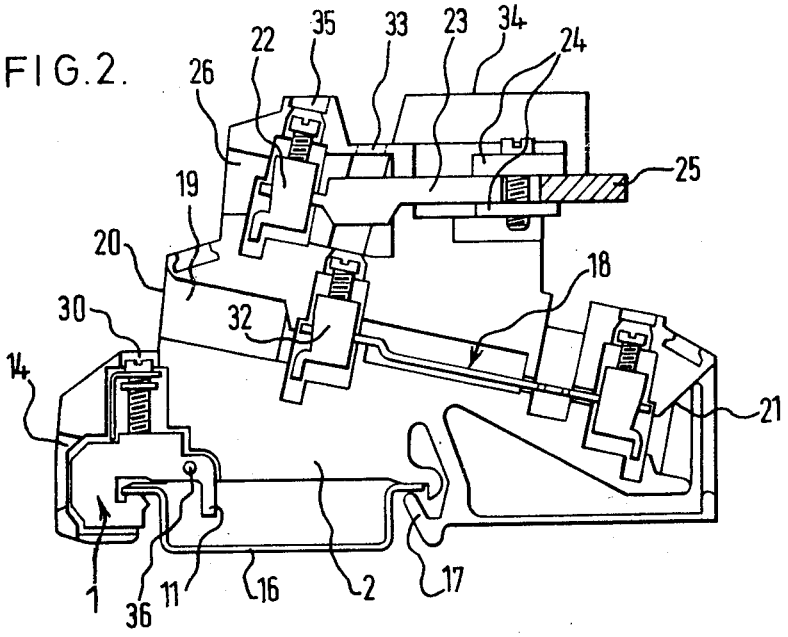
Figure 3:
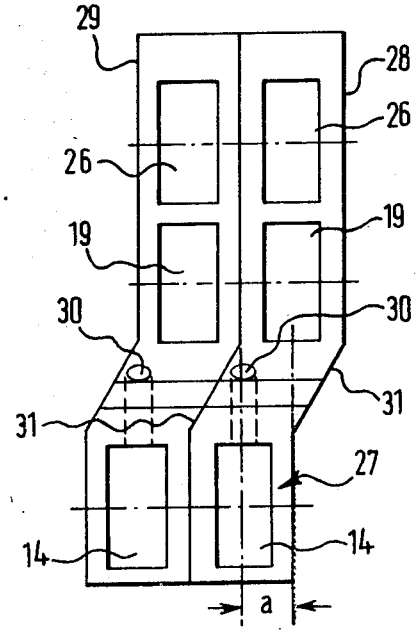

In order that the invention may be more clearly understood, reference will now be made to accompanying drawings, wherein an embodiment of the invention is shown for purposes of illustration, and wherein:

FIG. 1 shows part of a terminal block embodying the invention, mounted on a first type of support rail, FIG. 2 shows a second terminal block embodying the invention, mounted on a different support rail, and FIG. 3 is a side view of a pair of terminal blocks according to FIG. 2.

FIG. 1 shows a heavy-duty metal support rail 3 for carrying electrical terminals in well-known manner. The support rail has the standardized dimensions already mentioned, and the outwardly turned flanges 4 are of tapered cross-section with co-planar upper surfaces and upwardly sloping lower surfaces 5.

FIG. 1 shows the lower region of the insulating housing 2 of a terminal block mounted on the support rail. One side of the housing rests on the right-hand flange 4 and will in general be provided with a resilient detent so that the terminal block can be clipped onto and unclipped from the support rail. At its other side the housing contains an earth terminal 1 by means of which the terminal block is secured to the lefthand flange of the support rail.

The earth terminal consists of a clamping member 8, a clamping screw 6, and a saddle 7 through which the pressure of the clamping screw is transmitted to an earth conductor 13. The clamping member 8 is made of bent sheet metal forming a saddle or a tube of substantially rectangular cross section into which the conductor 13 is inserted through an access opening 14 in the insulating housing so as to lie between the tip of the clamping screw (from which it is protected by the saddle 7) and the upper surface of the flange of the supporting rail. Seen from the side as in FIG. 1, the clamping member has a generally L-shaped aperture defined by a first arm 9 which grips under the flange 4 substantially in line with the clamping screw, and a second arm 11 which projects into the channel of the support rail. The arm 9 has upwardly facing sharp teeth 10 and the arm 11 has a sharp tooth 12 facing the internal side surface 15 of the support rail.

In use, the aperture in the clamping member 8 is fitted over one flange of the support rail and the terminal block is then pressed down so as to engage the opposite flange of the support rail. After insertion of the earth conductor 13, the clamping screw 6 is tightened, thereby clamping the earth conductor against the top of the flange of the support rail and clamping the lower arm 9 of the clamping member against the underside of the flange. Because of the tapered cross section of the flange, the clamping member 8 will tend to drift to the left in FIG. 1, during which the teeth 10 will score the under surface of the support rail flange, until the tooth 12 of the inner arm 11 engages the internal channel surface 15. The drifting movement is thereby positively limited to an amount insufficient to stress the opposite region of the insulating housing, and the earth terminal cannot subsequently drift further and thereby reduce the clamping pressure.

The width of the gap between the ends of the arms 9 and 11 is such that the terminal block can be mounted easily on the support rail flange.

A terminal block incorporating the described earth terminal can also be mounted on a light-duty support rail, which for comparison is shown in FIG. 1 at 16. Since the flanges of this are narrower than those of the heavy-duty support rail 3, and the channel is therefore wider, the arm 11 will not engage the internal surface of the channel. However, this is no disadvantage, because the flanges of the standard light-duty support rail are of constant thickness and consequently there is no tendency for the earth terminal to drift across the flange under the influence of the clamping pressure.

The fact that only a single clamping screw is used to clamp the conductor and also to secure the earth terminal on the support rail, assures simple assembly, mounting and use of the terminal block.

FIG. 2 shows a terminal block mounted on a light-duty support rail 16, and it will be seen that the inner arm 11 of the earth terminal 1 does not touch the support rail. In this embodiment, the earth terminal does not have teeth for engaging the support rail. FIG. 2 shows one form of detent clip for holding the terminal block on the right-hand flange of the support rail. This clip is an integral part of the insulating plastic housing 2, the material of which is sufficiently resilient to allow the clip to flex when the housing is clipped onto the support rail. The clip 17 can be pulled clear of the support rail flange to release the terminal block.

The terminal block housing is generally slab-shaped, having parallel major side faces which are perpendicular to the support rail in use, and intervening narrow faces in which are provided access openings for the various terminals. The terminal block shown in FIG. 2 contains, above the earth terminal, a "live" terminal assembly 18 consisting of a pair of screw-clamping terminal sleeves and an interconnecting metal strip, sloping down from a conductor-access opening 19 in a front narrow face 20 of the housing to a conductor-access opening 21 in a rear narrow face of the housing. Above this is a neutral terminal assembly consisting of a screw-clamping terminal sleeve 22 connected by a metal strip 23 to a clamp 24 for clamping a busbar 25 at the rear of the terminal block. The terminal 22 is accessible through a conductor-access opening 26 in the front narrow face of the terminal block which is stepped.

The clamping screws of the various terminals are accessible through access openings in upwardly facing narrow faces of the terminal block, for insertion of a screw-driver or similar tool to clamp or release conductors.

Terminal blocks with a stacked arrangement of terminals are known, but have the disadvantage that access to the lower terminals is impeded by conductors connected to other terminals. Access to the earth terminal, which is the lowest because it must make direct contact with the support rail, is particularly difficult. It is to be noted that rail-mounted terminal blocks are commonly only 5 or 6 mm wide whereas the conductors may well be 3 or 4 mm thick, thereby substantially completely blocking access to any lower terminal. Changes of wiring at the lower terminals are therefore impossible unless the upper conductors are disconnected.

FIG. 3 shows an arrangement which overcomes this difficulty. The lower region 27 of the insulating housing, which accommodates the earth terminal 1, is laterally offset perpendicular to the major side faces 28, 29 of the insulating housing, by an amount a equal to one half of the thickness *2a* of the insulating housing. FIG. 3 shows two such terminal blocks side by side. It will be seen that the conductor access opening 14 and the upwardly facing tool access opening 30 for the earth terminal lie below the side face 29 of the upper part of the insulating housing. Consequently, the clamping screw and earth conductor are accessible between the conductors inserted in the upper openings 19 and 26. In particular, a screw driver or other tool can be inserted into the opening 30, passing between the upper conductors, to release or clamp an earth conductor.

To facilitate construction and mounting of the terminal blocks, the housing 2 preferably has oblique lateral surfaces 31 providing a transition between the upper side faces 28, 29 and the corresponding side faces of the offset lower region 27.

In the terminal block shown in FIG. 2, the front terminal 32 of the live terminal assembly 18 is set back behind the neutral terminal 22 and its clamping screw is accessible through opening 33 in the top narrow face 34 of the insulating housing, behind the tool access opening 35 of the terminal 22. The interconnecting strip 23 is shaped to allow passage of a tool inserted in the opening 33 to the clamping screw of the terminal 32, being for example twisted through 90° so as to lie edgewise.

The earth terminal has at its inner end a detent projection or hole 36 to engage with a hole or a detent projection of the insulating house, to keep the earth terminal in place. In the case of a terminal block intended to be used only on support rails 16, the downwardly projecting inner arm 11 may be omitted.

We claim:

1. An electrical terminal block for mounting on a support rail of channel section with outwardly directed flanges, comprising (a) an insulating housing provided with means for gripping one of said flanges; and (b) electrical terminals in said housing including an earth terminal provided with a first member arranged to engage under the other of said flanges of said support rail with a second member arranged to engage an internal side surface of the channel-section support rail adjacent to said other flange, and with a clamping screw arranged to clamp the said other flange against the said first member and to clamp an earth conductor in the earth terminal.

2. A terminal block as claimed in claim 1, in which a conductor access opening is provided for insertion of said earth conductor, said opening and clamping screw being so disposed that an inserted conductor will be clamped by said screw against said other flange.

3. A terminal block as claimed in claim 1 or 2, in which at least one of said first and second members is provided with at least one tooth for engaging said support rail.

4. A rail-mountable terminal block comprising (a) an insulating housing adapted to rest on one flange of a channel-section support rail with outwardly directed flanges, and (b) an earth conductor terminal which grips under the other of the flanges of said support rail by means of a clamping arm of an earth conductor-receiving clamping member of said terminal;

(c) said clamping member further comprising an abutment arm arranged to grip behind the flange region of said support rail; and (d) a common clamping screw is provided for clamping said conductor in said earth terminal and the latter to said support rail.

5. A terminal block as claimed in claim 4, wherein said abutment arm is provided at its free end with a sharp tooth disposed so as to face the neighboring region of said support rail.

6. A terminal block as claimed in claim 4 or 5, wherein said clamping arm is provided with sharp toothing at its free end on that side facing the underside of the flange of said support rail.

7. An electrical terminal block for mounting on a support rail of channel section with oppositely directed flanges, comprising a generally slab-shaped insulating housing provided with means for gripping said flanges, and electrical terminals in the housing, said insulating housing having parallel major side faces extending transversely to said support rail in use, and intervening narrow faces, and in which said housing accommodates terminals for earth, neutral, and live conductors, said earth, neutral, and live terminals being respectively at different levels with respect to said support rail and each having a conductor access opening in a said narrow face facing in a first direction and having a tool access opening in a further said narrow face facing away from said support rail, the region of said housing nearest said support rail, which accommodates said earth terminal, being offset relative to the region accommodating said live and neutral terminals by half the thickness of said housing, in a direction perpendicular to said major side faces.

8. A terminal block as claimed in claim 7, in which said side faces comprise oblique surfaces interconnecting said relatively offset regions.

* * * * *